US008168009B2

(12) United States Patent
Mesquita et al.

(10) Patent No.: US 8,168,009 B2
(45) Date of Patent: May 1, 2012

(54) HARD ALLOYS WITH DRY COMPOSITION

(76) Inventors: Rafael Agnelli Mesquita, Sao Manoel-Americana (BR); Celso Antonio Barbosa, Campinas (BR)

( * ) Notice: Subject to any disclaimer, the term of this patent is extended or adjusted under 35 U.S.C. 154(b) by 400 days.

(21) Appl. No.: 12/310,440

(22) PCT Filed: Jul. 18, 2007

(86) PCT No.: PCT/BR2007/000187

§ 371 (c)(1),
(2), (4) Date: Feb. 25, 2009

(87) PCT Pub. No.: WO2008/025105

PCT Pub. Date: Mar. 6, 2008

(65) Prior Publication Data

US 2009/0196786 A1 Aug. 6, 2009

(30) Foreign Application Priority Data

Aug. 28, 2006 (BR) ..... 0603856

(51) Int. Cl.

| | |
|---|---|
| ***C22C 38/22*** | (2006.01) |
| ***C22C 38/24*** | (2006.01) |
| ***C22C 38/26*** | (2006.01) |
| ***C22C 38/34*** | (2006.01) |
| ***C22C 38/36*** | (2006.01) |

(52) U.S. Cl. ..... 148/328; 148/334; 420/101; 420/102; 420/110; 420/111

(58) Field of Classification Search ..... 420/101, 420/102, 110, 111; 148/328, 334, 335; 75/246, 75/236

See application file for complete search history.

(56) References Cited

U.S. PATENT DOCUMENTS

| | | | | | |
|---|---|---|---|---|---|
| 3,901,690 | A | * | 8/1975 | Philip et al. | 420/9 |
| 4,224,060 | A | * | 9/1980 | de Souza et al. | 420/100 |
| 5,435,827 | A | * | 7/1995 | Wisell | 75/236 |
| 5,674,449 | A | | 10/1997 | Liang et al. | |
| 6,162,275 | A | * | 12/2000 | Jonsson et al. | 75/238 |
| 6,200,528 | B1 | * | 3/2001 | Rodney et al. | 420/110 |

FOREIGN PATENT DOCUMENTS

| | | | |
|---|---|---|---|
| EP | 0630984 | * | 12/1994 |
| GB | 1 522 274 | | 9/1979 |
| JP | 58-113356 | * | 7/1983 |
| JP | 01-159349 | * | 6/1989 |
| WO | WO 93/02818 | | 2/1993 |

* cited by examiner

*Primary Examiner* — Deborah Yee

(74) *Attorney, Agent, or Firm* — Nixon Peabody LLP; Jeffrey L. Costellia

(57) ABSTRACT

"HARD ALLOYS WITH DRY COMPOSITION", presenting a composition of alloy elements consisting, in mass percentage, of Carbon between 0.5 and 2.0; Chrome between 1.0 and 10.0; Tungsten-equivalent, as given by ratio 2Mo+W, between 7.0 and 14.0; Niobium between 0.5 and 3.5. Niobium can be partially or fully replaced with Vanadium, at a ratio of 2% Niobium to each 1% Vanadium; Vanadium between 0.5 and 3.5. Vanadium can be partially or fully replaced with Niobium, at a ratio of 2% Niobium to each 1% Vanadium; Cobalt lower than 8, the remaining substantially Iron and impurities inevitable to the preparation process. As an option to refine carbides, the steel of the present invention can have content of Nitrogen controlled, below 0.030 and addition of Cerium or other earth elements at content between 0.005 and 0.020. For the same purpose, Silicon and Aluminum can be optionally added, at content between 0.5 and 3.0% for both of them.

22 Claims, 12 Drawing Sheets

ET1 – MEV secondary electrons

Vanadium

Tungsten

Molybdenum

ET2 – MEV secondary electrons

Vanadium

Tungsten

Molybdenum

PI1 – MEV secondary electrons

Vanadium

Tungsten

Molybdenum

Niobium

PI2 – MEV secondary electrons

Vanadium

Tungsten

Molybdenum

Niobium

PI3 – MEV secondary electrons

Vanadium

Tungsten

Molybdenum

Niobium

PI4 – MEV secondary electrons

Vanadium

Tungsten

Molybdenum

Niobium

Figure 1:
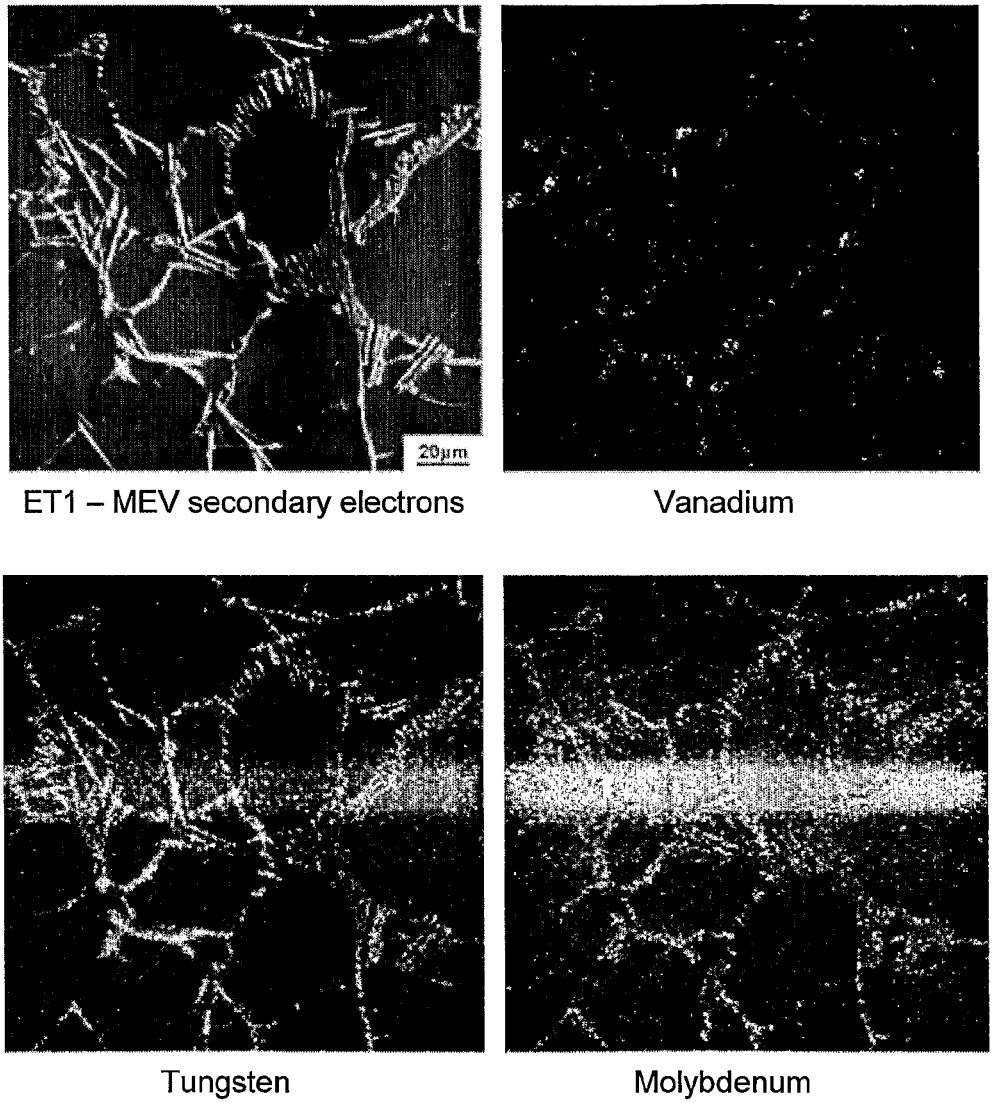

High N (270 ppm) Low N (110 ppm)

High N (300 ppm) + Ce (380 ppm) Low N (120 ppm) + Ce (550 ppm)

—● Eutectic carbides

—→ Primary carbides

HARD ALLOYS WITH DRY COMPOSITION

This invention addresses hard alloys to be used in cutting and machining tools, having as main feature the use of vanadium and niobium as alloy elements. Accordingly, they allow for the use of a smaller content of the tungsten and molybdenum alloy elements, which are costly. The thorough alloy design, based on its microstructural aspects, allows for the alloys of this invention to have properties equal to those of the conventional hard alloys used in cutting tools, in addition to a significant cost reduction of the alloy.

The cutting tools, which the alloys of this invention are intended for, are used in a great number of machining operations. The chief examples of such tools are the drills, which currently represent the absolute majority of the world consumption of such materials. Other important tools are grinders, taps, tacks, saws and tool bits. For such applications, the alloys used are required to have a number of properties, of which these three are the most important: wear and tear resistance, hot resistance, in view of the high machining temperatures, and toughness, in order to avoid splits or breaks of the cutting areas of the tool.

The metallic mechanical industry is the greatest consumer of this kind of tools. In drilling operations which mainly use drills, a greatest yield production and up-to-date equipment currently makes use of, in addition to hard alloys, a great amount of tools made with carbide-based materials. This material can be classified as a metal ceramic compound. It provides a significant life increase in terms of wear and tear, although it has a significantly higher cost. On the other hand, lower complexity operations mainly use hard iron-based alloys, as for instance aluminum drilling or other non-ferrous alloys, wood cutting, lower yield machining and, likewise important, the household use. Additionally, the greater fragility of hard metals causes higher break sensitivity caused by vibrations, thus inhibiting their use in older equipment, in addition to hindering their use in some specific types of tools, such as taps.

Accordingly, hard ferrous alloys are greatly used in cutting tools because of their mechanical and tribological properties, in addition to, equally important, their cost competitiveness as related to hard metal tools. However, the high world steel and ferrous alloy consumption has led to a significant cost increase for such alloys. As regards drills, for example, most of their cost is due to the raw material cost, namely, the alloy used to manufacture them. Thus, the alloy cost increase reduces the competitiveness of such material in a number of situations, migrating either to hard metal use, or to low alloy and lower performance steels.

Typical examples of hard allows for cutting tools are the AISI M or AISI T series compositions, where AISI M2 steel is the most important. For those tools requiring more strain, cobalt alloys are used. M42 and M35 steels are the main examples of this class, the former being mostly used. The base chemical composition of these alloys is shown in Table 1, where the tungsten, molybdenum, vanadium and cobalt elements are the most important—which mostly contribute to the final cost of the alloy. The cost effect of such elements is shown in Table 2, as normalized by the alloy cost in June 2006.

Accordingly, there is a clear need for new hard alloy compositions, feasible for industrial production, able to meet the need for a lower content of costly alloy elements and with an equal performance. M2 steel is the primary and most important material, for which the development of an alternative alloy is required. As regards cobalt-related compositions, M42 would be the main element to be replaced.

The alloys of this invention meet all such needs.

TABLE 1

Prior art alloys.

| Type | Name | C | Cr | Mo | W | V | Co | Mo + 0.8V + 0.6W + 0.6Co | Minimum Hardness (HRC) |
|---|---|---|---|---|---|---|---|---|---|
| Hard conventional alloys | AISI M2* | 0.85 | 4.0 | 5.0 | 6.0 | 1.9 | — | 10.1 | 64 |
| | AISI M7 | 1.00 | 4.0 | 8.7 | 1.7 | 1.9 | — | 11.2 | 65 |
| | AISI T1 | 0.80 | 4.0 | — | 18.0 | 1.0 | — | 11.6 | 64 |
| Hard cobalt alloys | AISI M42* | 1.10 | 4.0 | 9.5 | 1.4 | 1.0 | 8.2 | 16.1 | 64 |
| | AISI M35 | 0.86 | 4.0 | 5.0 | 6.0 | 1.9 | 5.0 | 13.1 | 65 |

Only the main alloy elements are shown, according to mass and iron balance percentages. The sum of the elements' cost effect is computed through the formula Mo + 0.8 V + 0.6 W + 0.6 Co, with the cost-related rates of each element in April 2006 being normalized to the 1% cost of molybdenum.
*More important in the class.

The properties of hard ferrous alloys used in cutting tools are closely related to the carbides existing in their microstructures, whether they are large non-dissolved carbides, as micrometers, or very thin carbides, as nanometers. The former are important as regards the wear and tear resistance of the material, while the latter provide hardness after a thermal treatment and hot resistance. The alloy elements' performance in the formation of such carbides was thoroughly reviewed and modified as regards the conventional concept. For that purpose, this invention makes use of the niobium as an alloy element, thus reducing the total molybdenum, tungsten and vanadium content.

This work, however, was not focused on the conventional substitution of alloy elements. In many papers of several material scientific and chemistry areas, the substitution of alloy elements with similar characteristics has been addressed. Important examples in connection with this invention are the 4B a 5B family elements of the periodic table, namely, titanium, vanadium, zirconium, niobium and tantalum. In many situations these elements provide similar effects, since they have a similar atomic structure. However, in hard alloys for cutting tools, significant differences occur. Vanadium is greatly used for these materials, and whenever it is substituted by niobium, the vanadium important beneficial effects are lost, particularly as regards the secondary hardening. Accordingly, the alloys of this invention are not provided with a significant vanadium content, which is not substituted by niobium, but rather added concurrently.

Unlike vanadium, niobium causes little secondary hardening, although it builds primary carbides very easily. Such carbides are MC-type carbides, with high hardness, much higher the hardness of other primary types built in hard conventional alloys. Consequently, the content of the other primary carbide builder elements, mainly tungsten and molybdenum, could be reduced, and this is the principle of this invention, which has as purpose to substitute the M2 alloy. Alternatively to M42, the most effective primary niobium carbides have been used to promote the reduction of the cobalt content as well, another costly element.

In addition to providing a definition for the best alloy, this invention was also concerned with the industrial production of that material. In heavier ingots, niobium tends towards the formation of primary carbides with significantly bigger sizes than the carbides usually present in such alloys; their carbides are known as block carbides in the English literature. Such carbides jeopardize the niobium beneficial effect because, if they were more dispersed, they would promote a higher wear and tear resistance. Additionally, primary coarse carbides also reduce other properties of these alloys, such as grindability and toughness. Accordingly, another purpose of this invention was to actuate in the coring mechanism of niobium carbides during solidification, thus promoting their refinement in the end product.

With a view to meet the conditions above, the alloys of this invention are provided with alloy elements that, as regards mass percentage, consist of:

0.5 to 2.0 C, preferably 0.8 to 1.5 C, typically 1.0 C.

1.0 to 10.0 Cr, preferably 3.0 to 7.0 Cr, typically 4.0 Cr.

7.0 to 14.0 of $W_{eq}$ (equivalent tungsten), with $W_{eq}$ obtained by the $W_{eq}$=W+2.Mo ratio, preferably 8.5 to 11.5 $W_{eq}$, typically 10.0 $W_{eq}$.

0.5 to 3.5 Nb, preferably 1.0-2.5 Nb, typically 1.7 Nb, where Nb can be partially substituted by V, according to such ratio where 1.0% Nb corresponds to 0.5% V, or Nb can be either partially or totally substituted by Zr, Ti and Ta, according to such ratio where 1.0% Nb corresponds to 0.5% Ti or 1.0% Zr or Ta.

0.5 to 3.5 V, preferably 1.0-2.5 V, typically 1.8 V, where V can be either partially or totally substituted by Nb, according to such ratio where 1.0% Nb corresponds to 0.5% V. In case V is substituted by Nb, the final Nb content of the alloy must be computed according to that ratio, and then added to the existing alloy-specified content.

As described below, aluminum and silicon can be added concurrently to the alloys of this invention, providing benefits in terms of carbide refinement. However, compositions with no aluminum can also be produced in the alloys of this invention, because of greater easiness as regards the alloy manufacture and higher hardness provided. Thus, the aluminum and silicon contents must be dosed as follows, in mass percentage:

Maximum 1.0 Al and maximum 1.0 Si, preferably maximum 0.5 Al and Si, typically maximum 0.2 Al and Si for compositions with Al and Si as residue element. In such case; Al and Si must be treated as impurities.

0.2 to 3.5 Al or Si, preferably 0.5 to 2.0 Al or Si, typically 1.0 Al or Si, for compositions requiring Al and Si for microstructure refinement.

As described below, cobalt can also be added to the composition above, providing additional benefits as regards properties, in addition to making it an alternative to cobalt-related materials, such as M42. Thus, the cobalt content is optional to the alloys of this invention, depending on the use it is intended for.

In case of addition, it must be dosed as follows: 1.0 to 10.0 Co, preferably 3.0 to 7.0 Co, typically 5.0 Co.

In less costly alloys, namely, those intended for replacing usual conventional alloys such as M2, the cobalt content must be maximally 8.0, preferably maximum 5.0 Co, typically maximum 0.50 Co.

For niobium carbide refinement, important in the industrial production of ingots, the alloys of this invention can have the following controls, which are not necessarily mandatory for all uses, and therefore not mandatory for the alloy:

Maximum 0.030 N, preferably maximum 0.015 N, typically maximum 0.010 N.

0.005 to 0.20 Ce, preferably 0.01 to 0.10 Ce, typically 0.050 Ce, the other elements being rare earth; rare earth elements are the lanthanoid or actinoid family elements of the periodic table, and the La, Ac, Hf and Rf elements.

Iron balance and metallic or non-metallic impurities, which are unavoidable in the steel mill process, where such non-metallic impurities include, without limitation, the following elements, in mass percentage:

Maximum 2.0 Mn, preferably maximum 1.0 Mn, typically maximum 0.5 Mn.

Maximum 2.0 Ni, preferably maximum 1.0 Ni, typically maximum 0.5 Ni.

Maximum 2.0 Cu, preferably maximum 1.0 Cu, typically maximum 0.5 Cu.

Maximum 0.10 P, preferably maximum 0.05 P, typically maximum 0.03 P.

Maximum 0.20 S, preferably maximum 0.050 S, typically maximum 0.008 S.

The reasons for the new material composition specification are shown below, describing the effect of each alloy element. The percentages are defined in connection with the mass percentage.

C: Carbon is the main responsible for the thermal treatment response, the martensite hardness, the formation of primary carbides and secondary carbides which precipitate upon tempering. Their content must be below 2.0%, preferably maximum 1.5% so that, after quenching, the presence of the retained austenite is not too high, and, also, to avoid the formation of excessively coarse primary carbides. However, the carbon content must be sufficient for the formation of primary carbides, mainly whenever combined to niobium, as well as secondary carbides upon tempering, and provide the martensite hardening after quenching. Accordingly, the carbon content must not be below 0.5%, preferably carbon higher than 0.8%.

Cr: Chromium is very important for hard alloys used in cutting tools, to promote quenchability, namely, to allow for martensite formation with no need of too sudden coolings. Additionally, to provide a homogenous hardness for large pieces. For these effects, in the alloys of this invention, chromium must be provided with an above 1% content, typically above 3%. However, too high chromium contents cause the formation of coarse carbides, $M_7C_3$ type, thus causing grindability and toughness reduction. Accordingly, the alloys must be provided with chromium content lower than 10%, typically below 7.0%.

W and Mo: Tungsten and molybdenum have a very similar behavior in hard conventional alloys, in many cases interchangeable. In such alloys, tungsten and molybdenum have two effects: 1—To create eutectic carbides, $M_6C$ or $M_2C$ type, which are either totally or partially translated into $M_6C$ carbides, and which are little dissolved while being quenched. Such carbides, also called primary carbides, are important for wear and tear resistance. 2—A significant amount of tungsten and molybdenum builds secondary carbides, which are dissolved during austenitization, and during tempering after quenching they re-precipitate as very fine secondary carbides. These two tungsten and molybdenum effects are both important and spend almost the same amounts of these elements. With the M2 alloy, for example, with 6% molybdenum and 5% tungsten, approximately half of them is in solid solution after austenitization and quenching; the remaining half is kept as non-dissolved carbides. In the alloy of this invention, molybdenum and tungsten are added in contents mainly intended for a secondary hardening, and less for the formation of primary carbides; as described below, niobium plays this role. Accordingly, the amount of tungsten and molybdenum is spared, which in conventional alloys is intended for the formation of primary carbides, thus causing a significant cost reduction for the alloy.

V: Vanadium is as important as molybdenum and tungsten for the formation of primary carbides and secondary precipitation upon tempering. This element content was kept as practically unchanged as related to the M2 alloy. This is why the effect of the vanadium secondary precipitation is extremely important in these materials, since the element's carbides are highly coalescence-resistant, and therefore they are crucial for the material resistance to the high temperatures developed in cutting processes. The vanadium primary carbides are not greatly present in the M2 steel. However, these carbides are MC-type carbides, with hardness much higher than the $M_6C$ carbides (molybdenum and tungsten-enriched), providing greater wear and tear resistance. Accordingly, the excessive vanadium which was not dissolved during the austenitization, was not reduced in the alloy of this invention, in view of the importance of the MC carbides as regards the material wear and tear resistance. Additionally, vanadium has a significant influence in the austenitic grain growth control during the austenitization. For all such effects, the vanadium content must be no lower than 0.5%, preferably higher than 1.2%. In order not to build excessively coarse carbides, and, further, not to excessively increase the alloy cost, the maximum vanadium content must be controlled, and it should be below 3.5%, preferably below 2.5%. Therefore, the vanadium content is not substituted by niobium, as described below, in the alloys of this invention. The alloy concept goes far beyond this point, being a completely different arrangement in terms of primary and secondary carbides built.

Nb: The niobium effect is crucial for the alloys of this invention, forming MC-type carbides, which can be eutectic or primary. Such carbides show high hardness, approximately 2400 HV, higher than the primary molybdenum and tungsten-enriched carbides, of the $M_6C$ type, with approximately 1500 HV hardness. The $M_6C$ carbides are the main carbides of conventional alloys, such as the M2 steel. In this invention, the volume of these carbides decreases through the molybdenum and tungsten content reduction; however, they are supplied by the carbides formed with the niobium introduction.

In addition to their higher hardness, the niobium carbides have less concentration in the form of splines, in view of their solidification in primary or eutectic, prior to the eutectic reaction of the molybdenum and tungsten carbides. In M2 steel, for example, the $M_6C$-type carbides derive from the $M_2C$ carbide decomposition, formed in the eutectic reaction and, therefore, very concentrated in the interdental spaces. After the metal forming, the carbides are arranged in splines, which allow for cracks and fragments in this direction. Accordingly, the niobium addition together with tungsten and molybdenum reduction provides for well distributed and high hardness carbides, thus being very desirable. The niobium carbides are formed at high temperature, and they are the first ones to be formed, although they do not dissolve significant amounts of molybdenum and tungsten, unlike the vanadium carbides. Accordingly, the content of these elements, although lower than the M2 alloy, is completely available for the secondary hardening.

In more alloyed metals, such as the M42 alloy, the niobium carbides provide a highly significant wear and tear, resistance, thus allowing for the reduction of the cobalt content as well. Through that modification, there is a hardness reduction, although the performance of the tools is still high because of the beneficial effect of the niobium carbides.

The final result of niobium introduction in the alloys of this invention can be summarized in three points: 1—Niobium creates carbides that slightly dissolve the other elements of the alloy, are provided with high hardness and are homogeneously distributed after the hot formation; all such aspects provide high wear and tear resistance. 2—Consequently, the primary tungsten and molybdenum carbides can be disregarded, thus allowing for a reduction of the total content of these elements, which are the most costly in alloys used in cutting tools. 3—With cobalt-related materials, such as M42, such element content can be reduced; this modification causes lower hardness after the thermal treatment, however, due to the existing niobium carbides, wear and tear resistance and the tools performance is still high.

For all such effects, the niobium content must be minimally 0.5%, preferably above 1.0%. However, too high niobium contents cause the formation of too coarse carbides, thus jeopardizing toughness and grindability of that material. Consequently, the niobium content must be lower than 3.5%, preferably lower than 2.5%.

N: Nitrogen can be controlled on an optional basis in the production of the alloys of this invention. In many situations, the industrial production of these materials causes coarse carbides in the end bars, which are unacceptable for the product quality. In such cases, it is extremely important to act in the solidification of primary niobium carbides, specifically as regards their coring. The 4B and 5B element families, which include niobium, build very stable nitrites at high temperatures. Such nitrites serve as cores for the MC carbides' solidification and, therefore, for the niobium carbides. Further, the sooner the MC carbide formation occurs, the longer will be the time available for their growth, which occurs whenever the eutectic temperature is reached. Accordingly, a possibility to solve the thickening problem of the primary niobium carbides is the reduction of the total nitrogen content of the alloy, thus removing the coring agents for that carbide. The nitrogen content must be as lower as feasible in the production by means of an electric steel mill, with nitrogen content below 0.025% being desirable, preferably below 0.015%, and optimally below 0.010%.

Ce and rare earth elements: Cerium and other rare earth elements, from the lanthanide or actinide families, can also act in the refinement of niobium carbides. At high temperatures, such elements build oxinitrites, thus reducing the free nitrogen in the liquid metal. They act as a second method to reduce the nitrogen content, and then the coring nitrites of the primary niobium carbides. The final result is a stronger manner to refine carbides and make their industrial production easier.

Si and Al: Aluminum addition has been tested, concurrently with the silicon content increase, as a method to provide higher refinement to the niobium carbides. Although it causes some refinement, these elements provide a hardness reduction after the thermal treatment. Accordingly, they must be used only in cases where the concern with the carbide size control is not feasible with the elements above, namely, by means of cerium addition and nitrogen reduction. In such cases, aluminum and silicon content must be minimally 0.5%, preferably equal to or higher than 1.0%. However, because of the high oxidation and a tendency to build inclusions, and also because of the hardening caused to ferrite, the maximum content of these elements must be lower than 3.5%, typically lower than 2%.

Residues: Other elements, such as manganese, nickel, copper and those usually obtained as normal residues of liquid steel development process, must be considered as impurities related to the steel mill deoxidization processes, or inherent to the manufacturing processes. Therefore, manganese, nickel and copper content is limited to 1.5%, preferably lower than 2.0%, in view of the increase in the retained austenite formation caused by such elements. Phosphorus and sulphur segregate in grain contours and other interfaces, and therefore phosphorus must be lower than 0.10%, preferably lower than 0.05%, with sulphur being lower than 0.20%, preferably maximum 0.050%.

The alloy, as described, can be made in the form of rolled or forged products by means of conventional or special processes, such as dust steelwork, spray formation or continuous casting, in products such as wire rods, blocks, bars, wires, plates and strips.

The following description of some experiments carried out makes reference to the attached figures, where:

FIG. 1 shows the crude microstructure of the prior art ET1 alloy fusion, showing the X-ray mappings of vanadium, tungsten and molybdenum elements. In such mapping, the greater the point density, the greater the relative concentration of the chemical element. Microstructure obtained through electronic scan microscopy (MEV), secondary electrons; X-ray mappings obtained through WDS.

Figure 2:
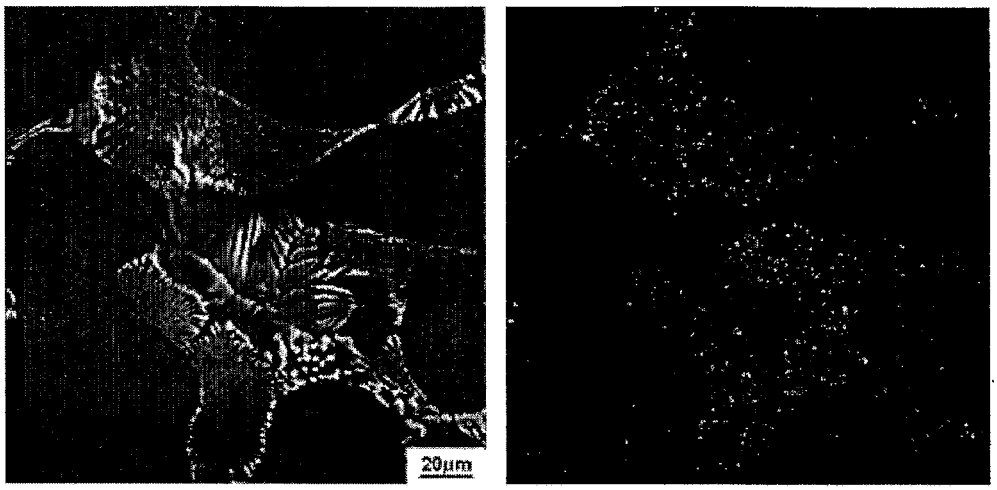
Figure 2:
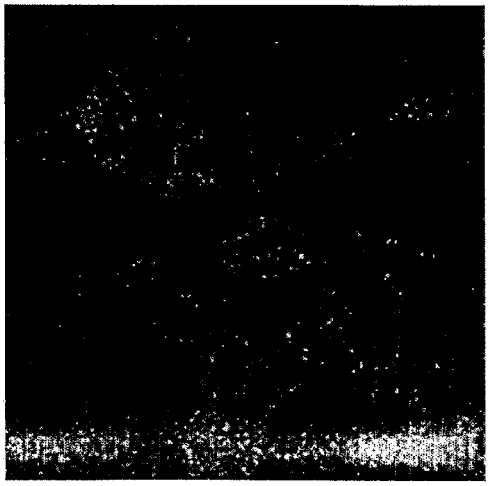
Figure 2:
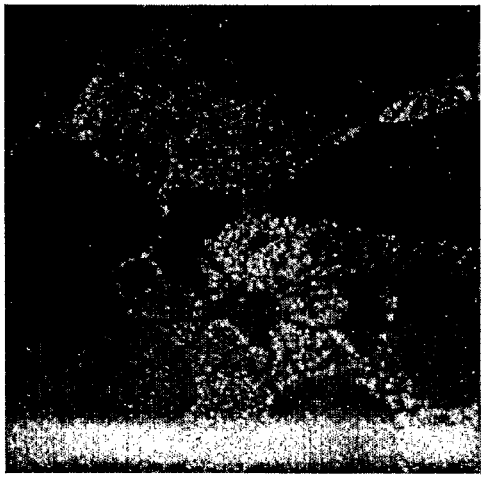

FIG. 2 shows the crude microstructure of the prior art ET2 alloy fusion, showing the X-ray mappings of vanadium, tungsten and molybdenum elements. In such mapping, the greater the point density, the greater the relative concentration of the chemical element. Microstructure obtained through electronic scan microscopy (MEV), secondary electrons; X-ray mappings obtained through WDS.

Figure 3:
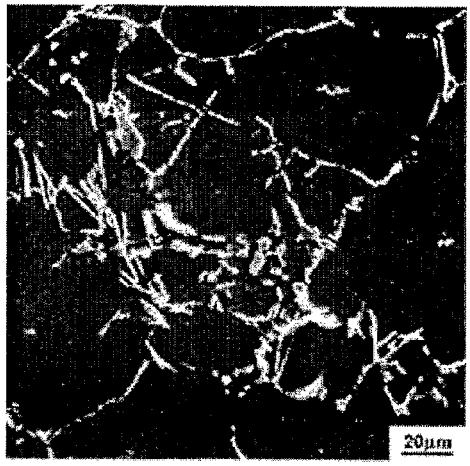
Figure 3:
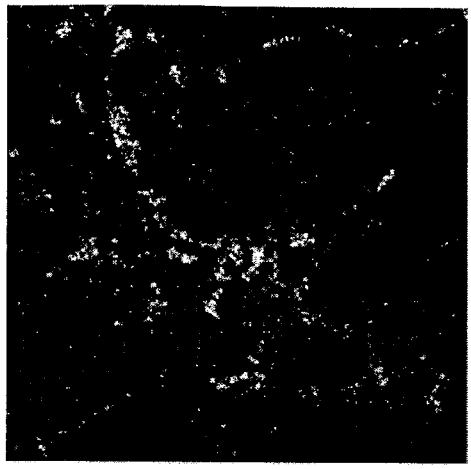
Figure 3:
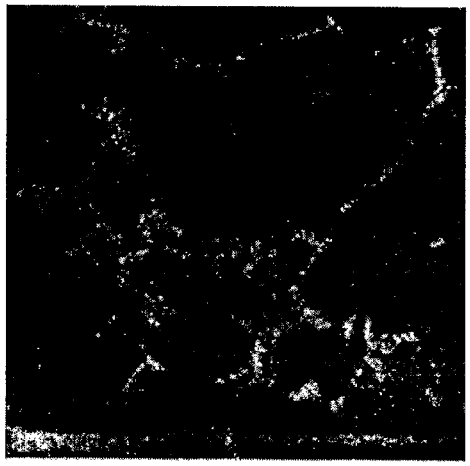
Figure 3:
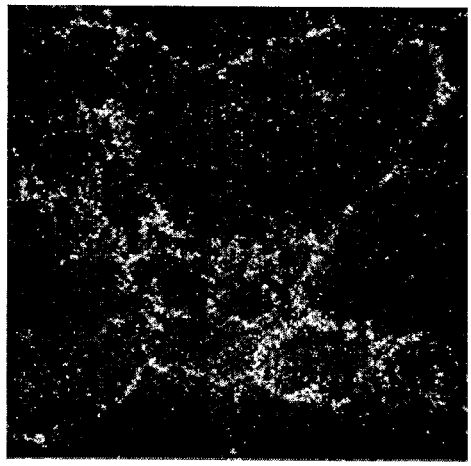
Figure 3:
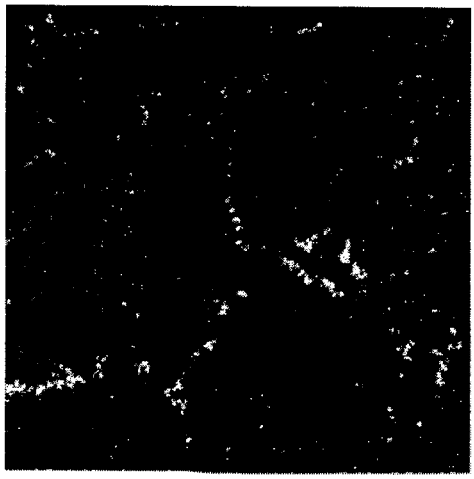

FIG. 3 shows the crude microstructure of the PI1 alloy fusion of this invention, showing the X-ray mappings of vanadium, tungsten, molybdenum and niobium elements. In such mapping, the greater the point density, the greater the relative concentration of the chemical element. Microstructure obtained through electronic scan microscopy (MEV), secondary electrons; X-ray mappings obtained through WDS.

Figure 4:
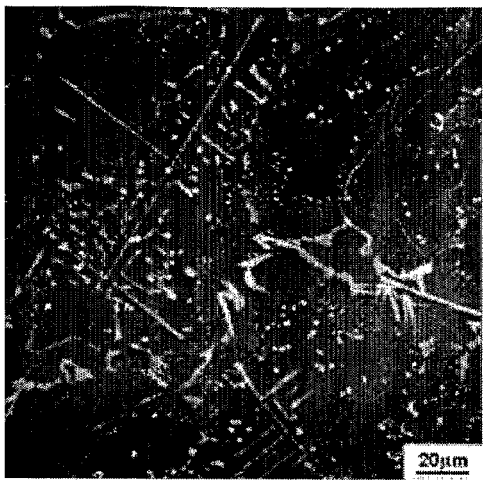
Figure 4:
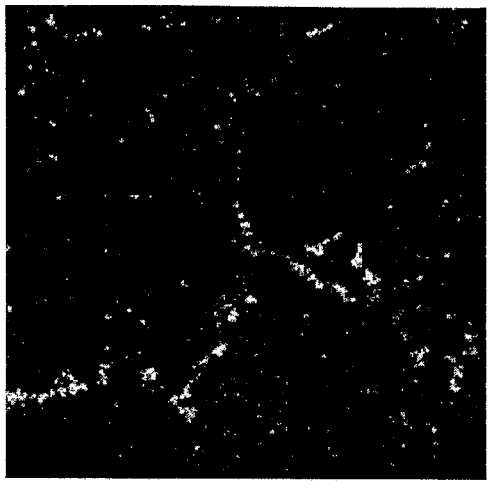
Figure 4:
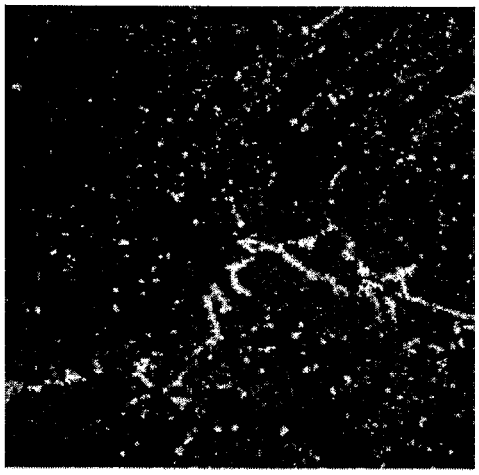
Figure 4:
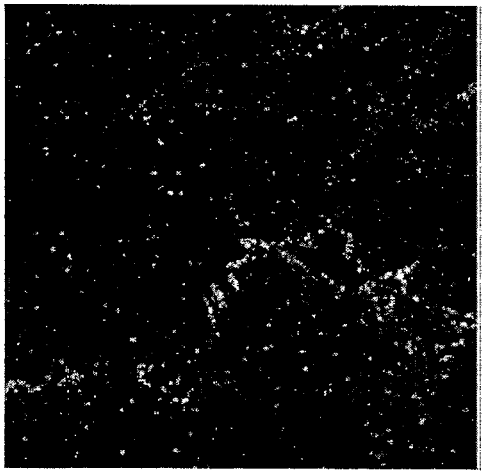
Figure 4:
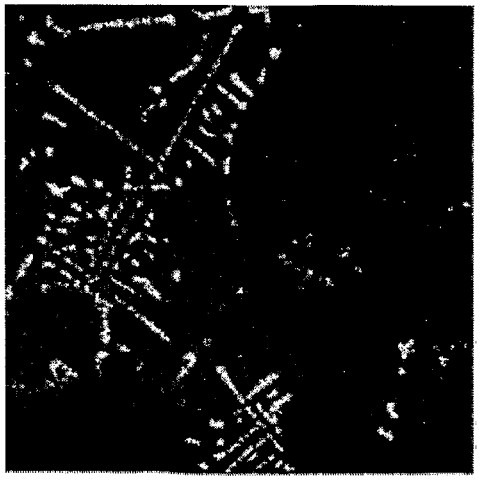

FIG. 4 shows the crude microstructure of the PI2 alloy fusion of this invention, showing the X-ray mappings of vanadium, tungsten, molybdenum and niobium elements. In such mapping, the greater the point density, the greater the relative concentration of the chemical element. Microstructure obtained through electronic scan microscopy (MEV), secondary electrons; X-ray mappings obtained through WDS.

Figure 5:
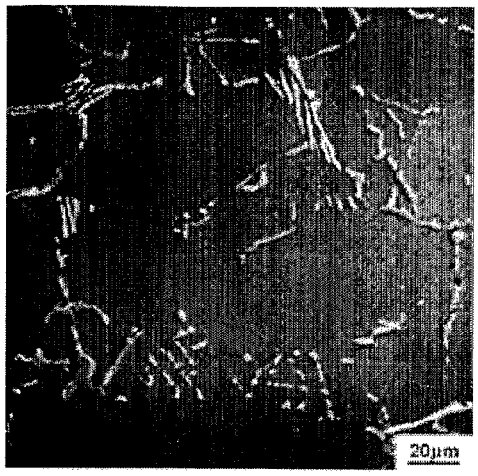
Figure 5:
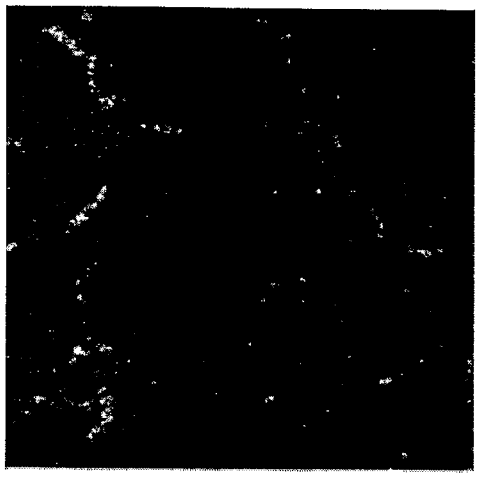
Figure 5:
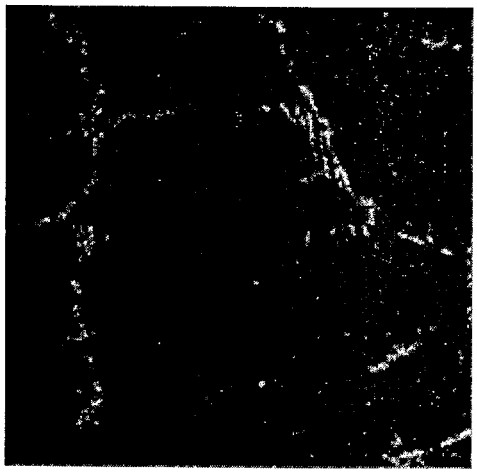
Figure 5:
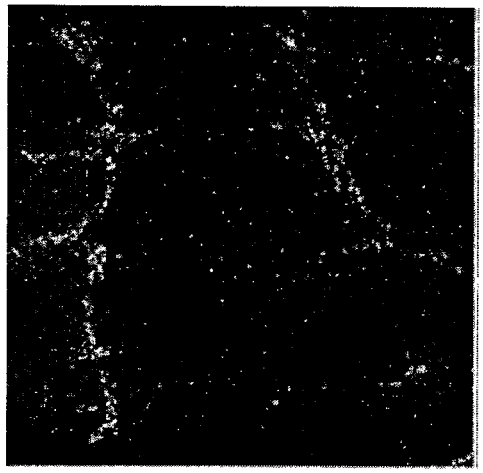
Figure 5:
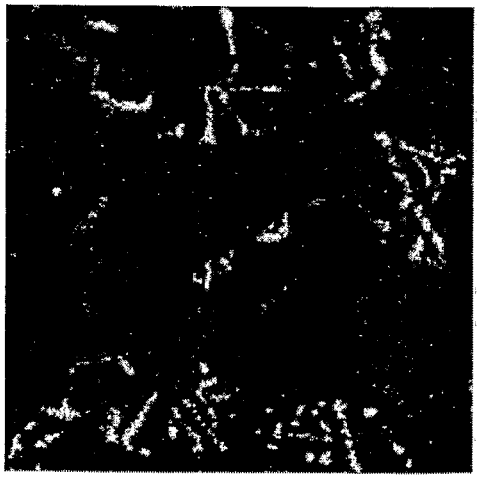

FIG. 5 shows the crude microstructure of the PI3 alloy fusion of this invention, showing the X-ray mappings of vanadium, tungsten, molybdenum and niobium elements. In such mapping, the greater the point density, the greater the relative concentration of the chemical element. Microstructure obtained through electronic scan microscopy (MEV), secondary electrons; X-ray mappings obtained through WDS.

Figure 6:
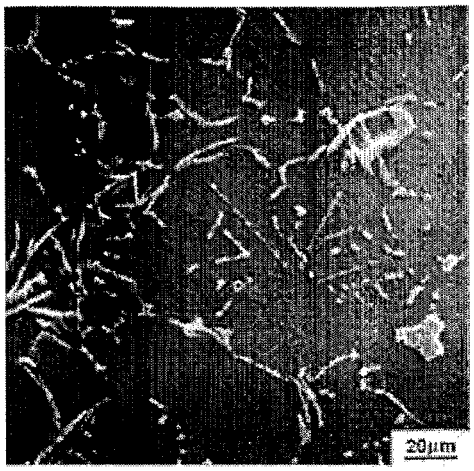
Figure 6:
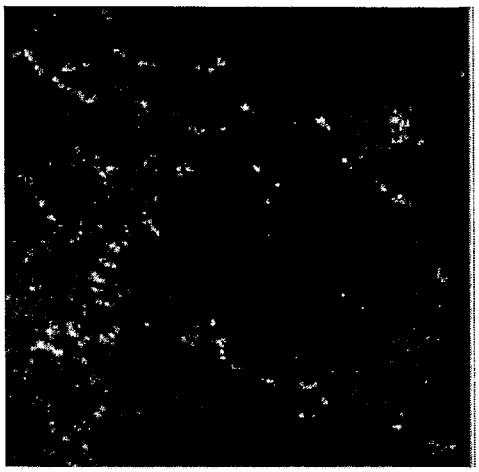
Figure 6:
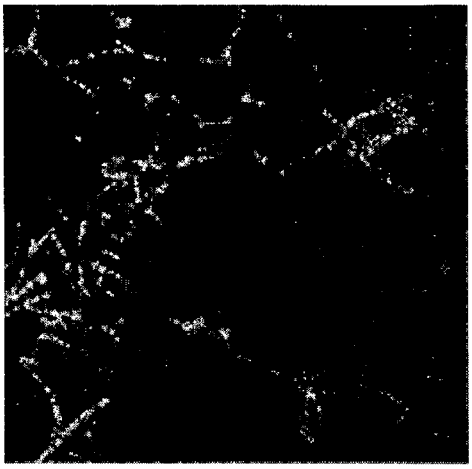
Figure 6:
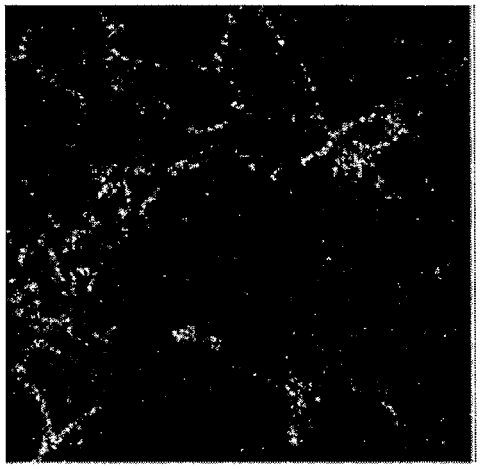
Figure 6:
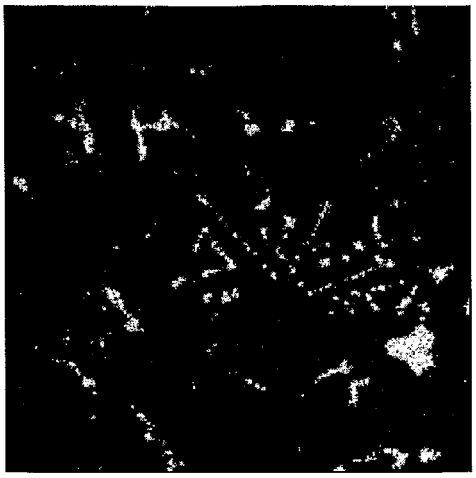

FIG. 6 shows the crude microstructure of the PI4 alloy fusion of this invention, showing the X-ray mappings of vanadium, tungsten, molybdenum and niobium elements. In such mapping, the greater the point density, the greater the relative concentration of the chemical element. Microstructure obtained through electronic scan microscopy (MEV), secondary electrons; X-ray mappings obtained through WDS.

Figure 7A:
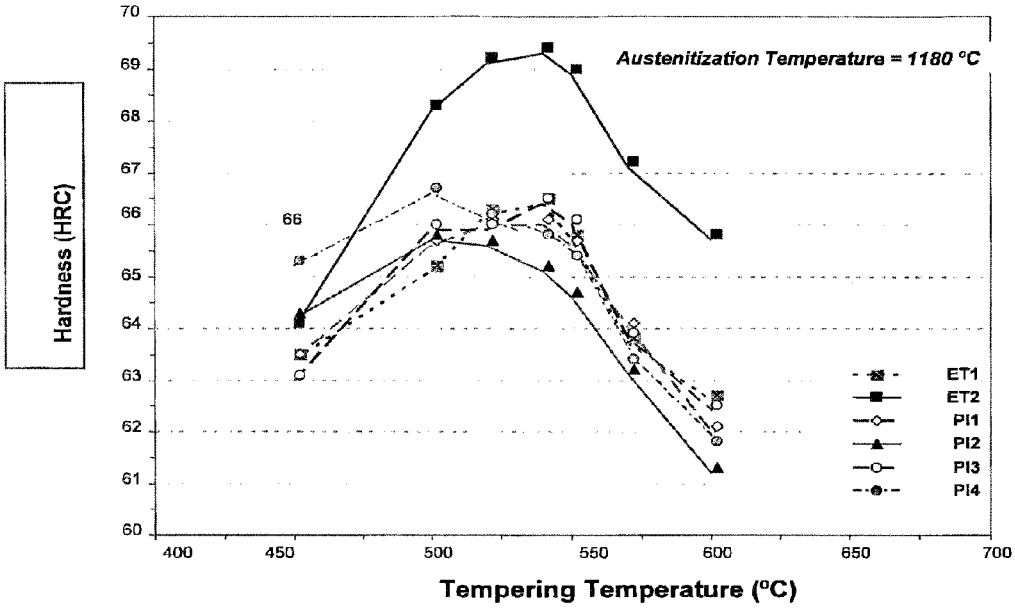
Figure 7B:
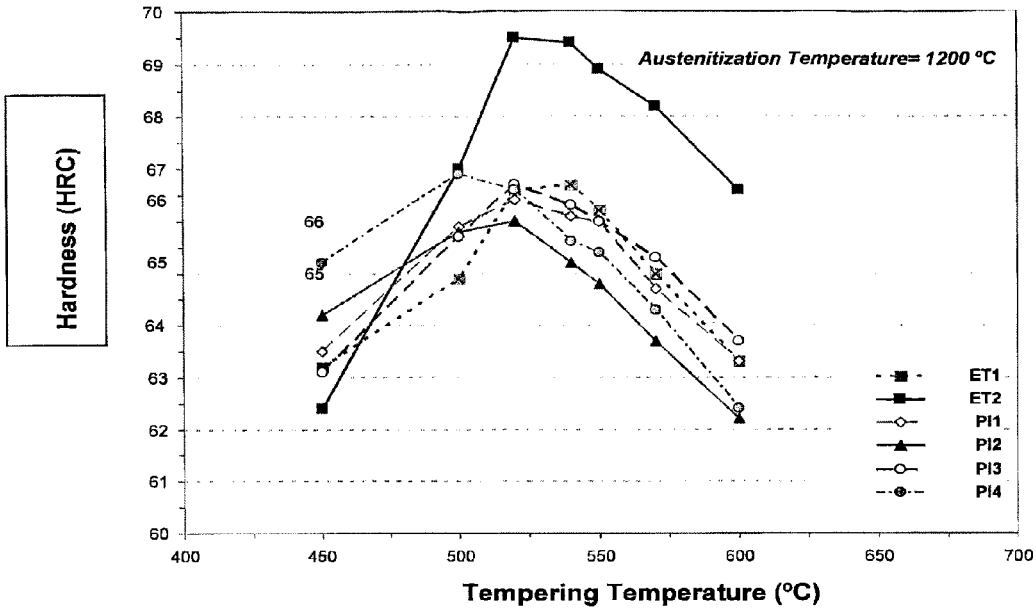

FIGS. 7A and 7B show the tempering curves of the alloys for two austenitization temperatures, identified at the right upper corner of each curve. Results for test specimens with 8 mm section, submitted to austenitization at the temperature shown, for 5 min in temperature oil quenching and dual tempering for 2 hours. All treatments were carried out under vacuum.

Figure 8:
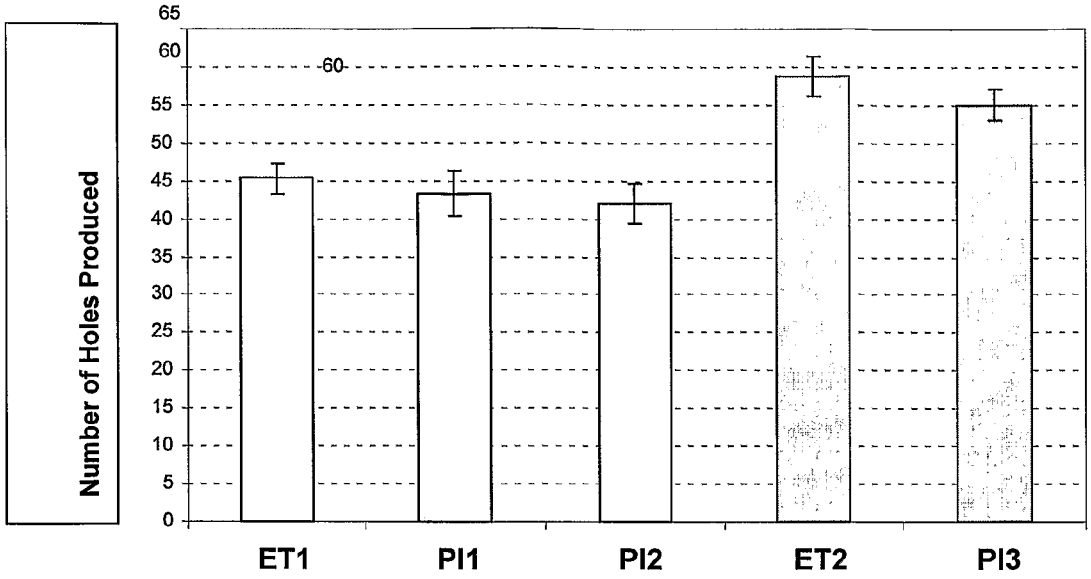

FIG. 8 shows the drilling test results for ET1, ET2, PI1, PI2 and PI3 alloys. The main test response is the number of drills performed up to the tool fault, whose values are shown by the bars and whose deviation is shown in the error bars. Test conditions: 4340 drilling improved to 41±1 HRC, 600 rpm revolution, cutting speed 13.56 m/min and advance of 0.06 mm/turn.

Figure 9:
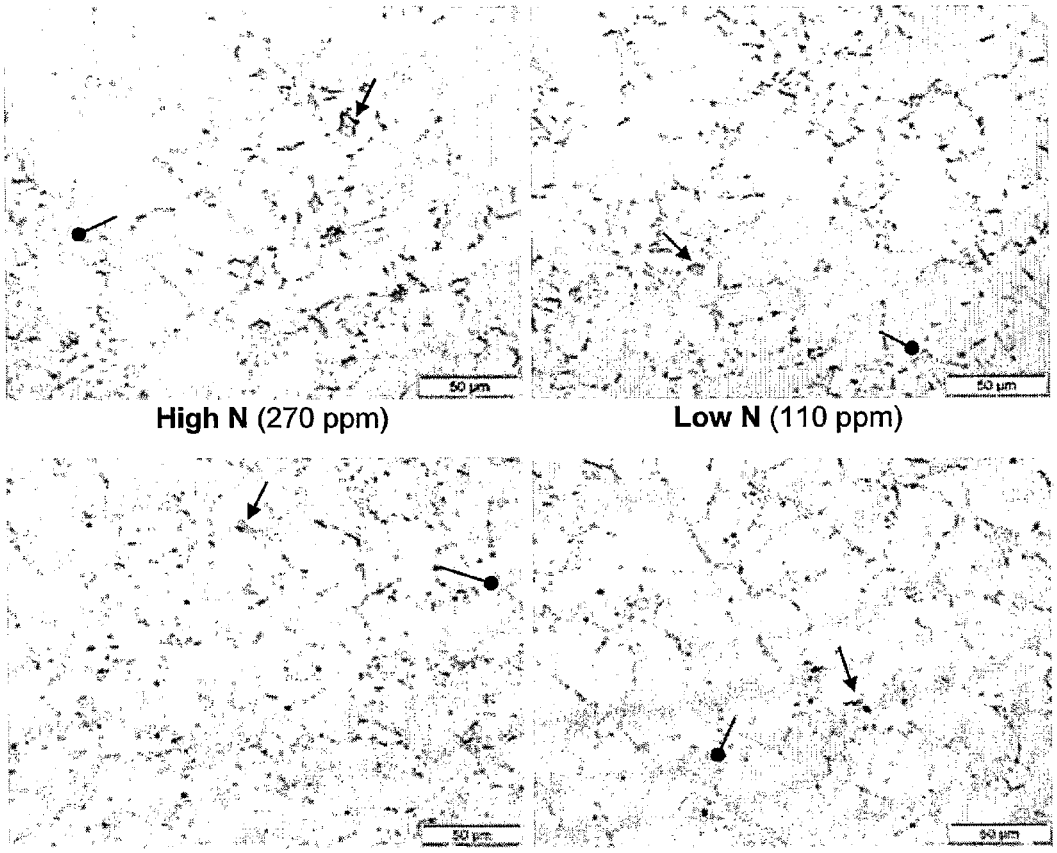

FIG. 9 summarizes the effect, in the crude solidification structure, of cerium addition and nitrogen content reduction in the PI1 alloy. The other elements were kept practically steady, as shown in Table 7. Samples in the crude solidification state, from 500 g ingots and round average section of about 40 mm. Optical photomicrographs of representative areas of the section half-radius; with no metallographic attack, only after diamond and alumina polishing.

Figure 10:
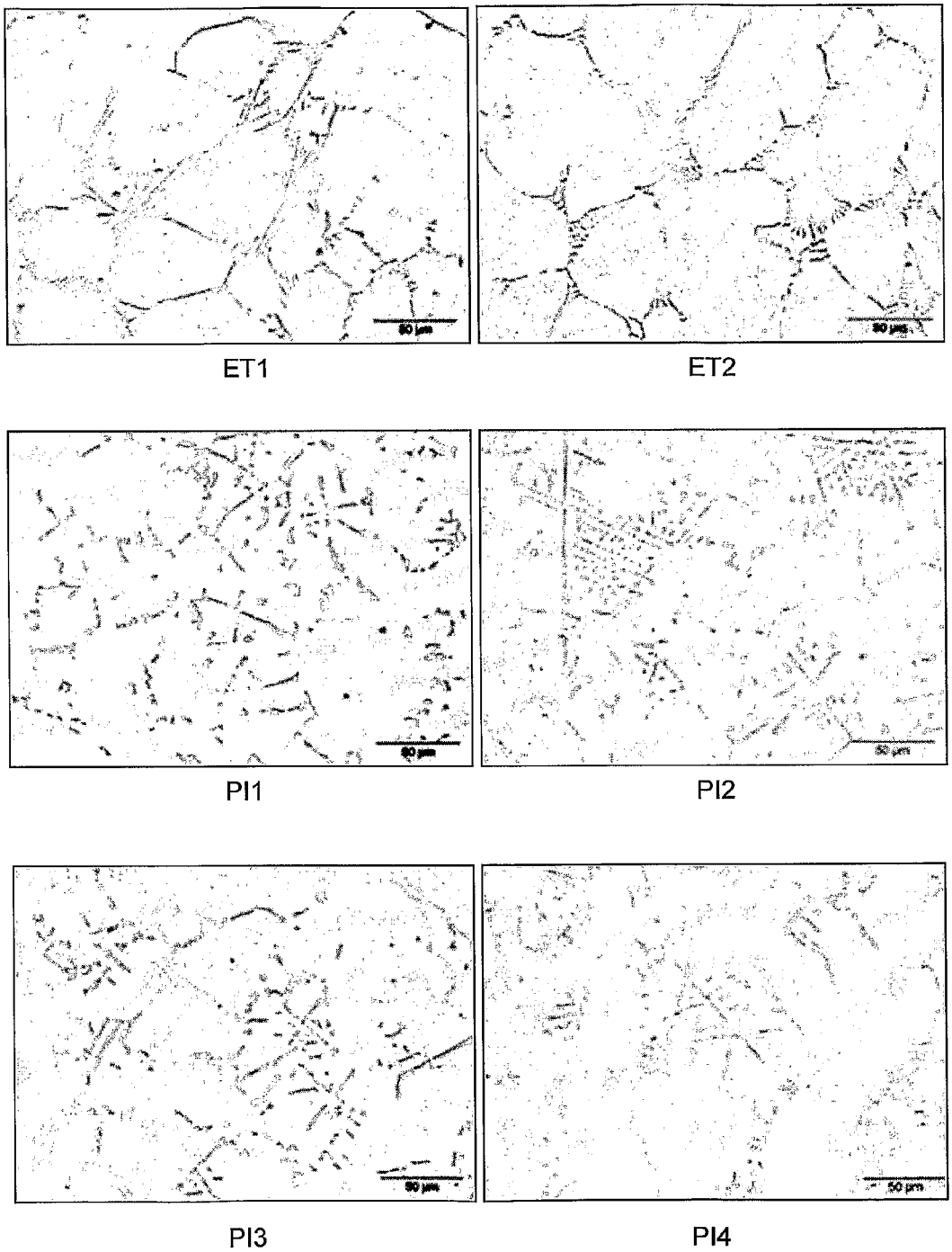

In FIG. 10, the crude solidification microstructures of the prior art ET1 and ET2 alloys, and PI1, PI2, PI3 and PI4 alloys are compared by means of optical microscopy. Areas of the test ingot base with 55 kg. Representative photomicrographs, with no metallographic attack, only after diamond and alumina polishing.

Figure 11:
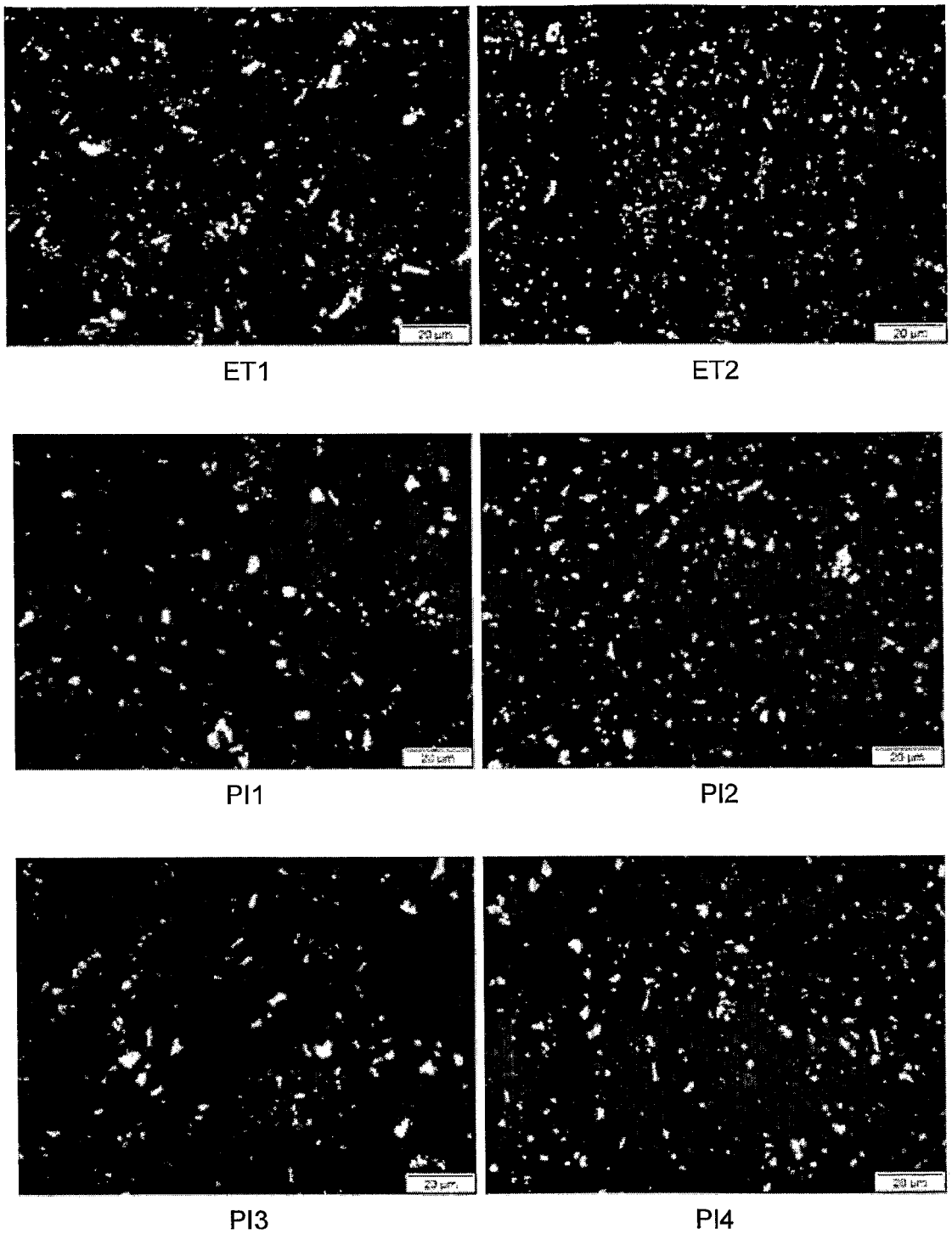

FIG. 11 compares a representative microstructure of each ET1, ET2, PI1, PI2, PI3 and PI4 alloy, in the quenched and tempered condition at the hardness peak, after deep attack with nital 4%. Approximately 500 times increase.

EXAMPLE 1

In order to define the alloy compositions of this invention, several alloys have been made and compared to the prior art alloys, included in the art. The chemical compositions are shown in Table 2; the alloys of this invention are hereinafter called P1, and the prior art alloys are called ET; ET1 alloy corresponds to M2 steel, and ET2 alloy corresponds to M42. The sum is also quantified, as normalized by the molybdenum cost, of the most costly elements: tungsten, molybdenum, vanadium and cobalt.

Table 2 shows a significant reduction of the alloy elements in the compositions of this invention, which is translated to a lower cost, as shown by the relative cost of the alloys shown in Table 3. As regards the alloy cost, PI1 and PI2 compositions must be compared to the prior art ET1 alloys, and PI3 and PI4 compositions must be compared to ET2 alloy, since these new compositions have as purpose to substitute the conventional alloys. Therefore, PI1 alloy of this invention causes a 38% reduction in the alloy cost as related to ET1, and for the Co compositions, one notices that PI3 alloy of this invention provides a 47% reduction in the alloy cost. Therefore, the alloys of this invention effectively meet the current need for cost reduction in cutting tool alloys. PI2 and PI4 alloys show no cost differences as related to PI1 and PI3 alloys, respectively, since the composition differences are only related to the aluminum and silicon content, which have a negligible cost in such alloys.

The ingot fusion was made by means of a similar procedure for the six alloys (ET1, ET2, PI1, PI2, PI3 and PI4), in a vacuum induction furnace, and leakage is carried out through cast iron ingot machines, producing an ingot of about 55 kg. After solidification, the ingots were annealed subcritically, and the six compositions were initially reviewed as regards the crude fusion microstructure, as shown in FIGS. 1 through 6. It can be clearly seen that the concentration of the vanadium, molybdenum and tungsten elements given by the point density in the X-ray image is significantly higher in the primary carbides of the ET1 and ET2 alloys, as related to the PI1, PI2, PI3 and PI4 alloys. On the other hand, these tend to build carbides with prevailing niobium element. These carbides are MC-type carbides and have high hardness; therefore, they can substitute satisfactorily the higher cost element carbides, such as tungsten and molybdenum. Additionally, the niobium carbides have an interesting characteristic: they have no significant amounts of other elements in solid solution, mainly molybdenum, tungsten and vanadium. Accordingly, they allow for these elements to be more free to build secondary carbides, which, after the final thermal tempering treatment, are important to verify the high hardness required for the uses of the material.

In addition to the discussion on the effect of primary carbides, hardness after the thermal treatment is crucial for the alloys intended for cutting tools. Hardness, mainly provided by secondary precipitation, is responsible for keeping the carbides fastened to the die, preventing them from being pulled out, thus providing the required mechanical resistance in a number of uses, and reducing the penetration of abrasives in the material. All such effects make the high hardness important for the wear and tear resistance of the materials. Therefore, the thermal treatment response has been reviewed after rolling of the trial ingots for round 8 mm bars. Samples of all compositions have been submitted to oil quenching treatments, with austenitization between 1180 and 1200° C.

TABLE 2

Chemical compositions of two prior art alloys (ET1 through ET4) and the alloys of this invention (PI).

| Element | | Alloy | | | | | |
|---|---|---|---|---|---|---|---|
| | | ET1 | ET2 | PI1 | PI2 | PI3 | PI4 |
| Nomenclature | | M2 | M42 | — | — | — | — |
| C | | 0.91 | 1.07 | 1.09 | 1.09 | 1.11 | 1.08 |
| Si | | 0.40 | 0.37 | 0.32 | 0.97 | 0.31 | 0.88 |
| Mn | | 0.29 | 0.32 | 0.33 | 0.32 | 0.33 | 0.33 |
| P | | 0.026 | 0.031 | 0.019 | 0.02 | 0.02 | 0.018 |
| S | | 0.0015 | 0.0033 | 0.004 | 0.004 | 0.005 | 0.004 |
| Co | | 0.17 | 8.14 | 0.10 | 0.004 | 4.96 | 4.89 |
| Cr | | 4.27 | 3.97 | 3.93 | 4.04 | 4.01 | 4.00 |
| Mo | | 4.93 | 9.55 | 3.19 | 3.24 | 3.12 | 3.29 |
| Ni | | 0.20 | 0.21 | 0.19 | 0.18 | 0.21 | 0.2 |
| V | | 1.85 | 1.16 | 1.76 | 1.78 | 1.71 | 1.77 |
| W | | 6.23 | 1.56 | 3.34 | 3.30 | 3.28 | 3.42 |
| Cu | | 0.11 | 0.12 | 0.11 | 0.13 | 0.12 | 0.13 |
| Ti | | 0.01 | <0.005 | 0.014 | 0.0013 | 0.009 | 0.012 |
| Nb | | 0.05 | 0.05 | 1.71 | 1.83 | 1.73 | 1.74 |
| Al | | 0.057 | 0.031 | 0.045 | 1.47 | 0.037 | 1.01 |
| N (ppm) | | 0.034 | 0.032 | 0.031 | 0.025 | 0.03 | 0.02 |
| O (ppm) | | 0.0016 | 0.0011 | 0.0012 | 0.0022 | 0.001 | 0.0011 |
| $W_{eq}$ (=W + 2Mo) | | 16.1 | 20.7 | 9.7 | 9.8 | 9.5 | 10.0 |
| Mo + 0.8V + | abs. | 10.3 | 16.3 | 6.7 | 6.6 | 9.4 | 9.7 |
| 0.6W + 0.3Co | relat. | 100 | 159 | 65 | 65 | 92 | 95 |

The sum of the contributions from Mo, W, V and Co for the cost is computed through the formula Mo + 0.8V + 0.6W + 0.6Co, with the rates being related to the cost of each element in April 2006, as normalized by the molybdenum cost. The sum is shown in absolute (abs.) and relative (relat.) terms, as normalized by ET1 alloy.

In summary, FIGS. 1 through 6 show that the primary carbides of PI1, PI2 and PI3 alloys are prevailingly niobium-enriched, as this element knowingly builds MC-type carbides. Such carbides consume a lesser amount of tungsten, molybdenum and vanadium than the primary carbides of the prior art alloys. Accordingly, they allow for the reduction of the total content of such elements in the alloy, which is the purpose of this invention.

TABLE 3

Metallic load cost, namely, the metal-alloy contained in ET1, ET2, PI1, PI2, PI3 and PI4 alloys.

| Alloy Cost | ET1 | ET2 | PI1 and PI2 | PI3 and PI4 |
|---|---|---|---|---|
| Cost of the alloy-contained metal, as normalized by the ET1 alloy cost. | 100 | 166 | 62 | 89 |
| Cost of the alloy-contained metal, as normalized by the ET2 alloy. | 60 | 100 | 37 | 53 |

Values normalized by the metallic load cost of ET1 or ET2 alloy. The costs of the PI1 and PI2 pair and PI3 and PI4 pair are equal, as the only difference refers to the Si and Al contents, whose influence in the alloy cost is negligible. The calculations are intended for electric steel mill production, with data of June 2006.

for 5 min, some of them also dually tempered, between 450 and 600° C., for 2 hours.

Table 4 shows hardness after quenching and tempering of the ET1, ET2, PI1, PI2, PI3 and PI4 alloys, for austenitization temperatures of 1180 and 1200° C.; as a graph, these results are shown in FIGS. 7A and 7B. These data show three important aspects. First, the fact that the ET1 and PI1 alloys have a similar behavior in terms of hardness, showing that, actually, the reduction of the molybdenum, tungsten and vanadium contents of the PI1 composition do not jeopardize hardness after tempering, since the content of these elements, which is necessary for the secondary hardening, is preserved. In such case, the PI1 alloy of this invention reaches one of its important results: to provide a reduction of the alloy elements, by keeping the same hardness. Additionally, the PI1 alloy is mainly provided with primary MC-type carbides, which have higher hardness and consequently provide high wear and tear resistance.

The second important conclusion obtained from the data after the thermal treatment is the lower hardness of the PI3 alloy as related to ET2 alloy, which it intends to substitute. Such fact occurs because, as shown by Table 2, there is a significant reduction mainly of the molybdenum and cobalt content of the PI3 alloy as related to the ET2 alloy, and the content resulting from these elements is not sufficient to cause the same hardness after the thermal treatment. In this sense, the greater molybdenum content of the ET2 alloy is important to provide the fine precipitation of carbides, while cobalt has an important effect in the precipitation and coalescence kinetics of the carbides. In spite of a lower hardness, the harder niobium carbides can still cause an adequate performance, as shown in Example 2.

The third important conclusion on the hardness results refers to the aluminum and silicon effects. The PI2 and PI4 alloys are comparative to the PI1 and PI3 alloys, respectively, although they have much higher aluminum and silicon contents (around 1.0 to 1.5%). FIGS. 7A and 7B curves and Table 4 data show a hardness reduction after the alloys with high silicon and aluminum content are tempered, and, in this case, high contents are not desirable. However, as shown comparatively by FIGS. 3 through 6, and as described in Example 3 and FIG. 10, high aluminum and silicon contents provide a refinement of the carbides. Thus, for those uses where the carbide refinement is an important issue, the alloys of this invention can have the addition, of high silicon and aluminum contents.

TABLE 4

Response to heat treatment of the alloys of the art (ET1 and ET2) and the alloys of the present invention.

| Al- | Austenitization Temperature = 1180° C. Tempering Temperature | | | | | | |
|---|---|---|---|---|---|---|---|
| loys | 450° C. | 500° C. | 520° C. | 540° C. | 550° C. | 570° C. | 600° C. |
| ET1 | 63.4 | 65.1 | 66.2 | 66.4 | 65.7 | 63.7 | 62.6 |
| ET2 | 64.0 | 68.2 | 69.1 | 69.3 | 68.9 | 67.1 | 65.7 |
| PI1 | 63.4 | 65.6 | 66.0 | 66.0 | 65.6 | 64.0 | 62.0 |
| PI2 | 64.2 | 65.7 | 65.6 | 65.1 | 64.6 | 63.1 | 61.2 |
| PI3 | 63.0 | 65.9 | 65.9 | 66.4 | 66 | 63.8 | 62.4 |
| PI4 | 65.2 | 66.6 | 66.1 | 65.7 | 65.3 | 63.3 | 61.7 |

| Al- | Austenitization Temperature = 1200° C. Tempering Temperature | | | | | | |
|---|---|---|---|---|---|---|---|
| loys | 450° C. | 500° C. | 520° C. | 540° C. | 550° C. | 570° C. | 600° C. |
| ET1 | 63.2 | 64.9 | 66.6 | 66.7 | 66.2 | 65 | 63.3 |
| ET2 | 62.4 | 67.0 | 69.5 | 69.4 | 68.9 | 68.2 | 66.6 |
| PI1 | 63.5 | 65.9 | 66.4 | 66.1 | 66.0 | 64.7 | 63.3 |
| PI2 | 64.2 | 65.8 | 66.0 | 65.2 | 64.8 | 63.7 | 62.2 |
| PI3 | 63.1 | 65.7 | 66.7 | 66.3 | 66.0 | 65.3 | 63.7 |
| PI4 | 65.2 | 66.9 | 66.6 | 65.6 | 65.4 | 64.3 | 62.4 |

Results of HRC hardness after austenitization at 1180 and 1200° C., quenching in oil and double two-hour tempering at the indicated temperature.

Another important parameter for such alloys is the size of the austenitic grain. This is always related to the toughness and resistance to wear for microchippings. Such figures have been evaluated in the case of the alloys at issue, and the results are shown in Table 5, after several austenitization conditions. Alloy ET1 and its alternate alloy, PI1, have similar grain size, like ET2 and the alternate PI3. As for alloys PI2 and PI4, the grain size is thinner, probably due to such also more refined carbides of those alloys, which prevent the growth of grains during austenitization. Therefore, this is another beneficial effect of such elements.

TABLE 5

Size of austenitic grains, as measured by the Snyder-Graff intercept method, for steels austenitized between 1160 and 1200° C.

| Alloy | $T_{Aust}$ 1200° C. |
|---|---|
| ET1 | 12.2 ± 1.8 |
| ET2 | 15.0 ± 1.9 |
| PI1 | 12.5 ± 1.3 |
| PI2 | 16.0 ± 1.5 |
| PI3 | 14.1 ± 1.3 |
| PI4 | 17.0 ± 2.0 |

The indexes ± indicate the standard deviation of the measures.

EXAMPLE 2

Alloys developed and described as shown in Example 1 have been tested for industrial applications. After rolling for 8.0-mm gauges and reduction to smaller gauges through hot wiring, drill-type tools were manufactured out of the pilot scale batches. Drilling tests were then performed under conditions similar to those used for industrial drills, and the performance of the alloys in the present invention was compared to the alloys of the art.

The results of the drilling tests are shown in Table 6 and, graphically, in FIG. 8. Considering the experimental deviation, equivalent results are seen for alloys PI1 and ET1 and alloy PI3 and ET2. This result validates the whole composition adjustment described for such alloys, that is, the use of niobium as a builder of primary carbides, the reduction in the content of molybdenum and tungsten for this purpose and the employment of such elements intended especially for the secondary hardening. A result to be highlighted is the one of alloy PI3 as regards ET2. In spite of having a much lower degree of hardness, as shown in Table 4 and FIGS. 7A and 7B, alloy PI3 could show a quite similar performance. This was even equivalent to that of alloy ET2, if test dispersion is considered.

TABLE 6

Results of the cutting test, carried out with drills from several tested alloys.

| Number of | Number of Holes |
|---|---|
| ET1 | 45.3 ± 2.1 |
| PI1 | 43.3 ± 3.1 |
| PI2 | 42.0 ± 2.6 |
| ET2 | 59.2 ± 2.7 |
| PI3 | 55.0 ± 2.0 |

Figures to test at least three tools. Test conditions: 600 rpm, cutting speed of 13.56 m/min, advance of 0.06 mm/turn and drills 6.35-mm diameter. The figures after "±" indicate the standard deviation of the measurements.

Therefore, the results discussed above show the efficacy in the alloy developed. As shown in Table 3, the alloys of the present invention have a reduction in the alloy cost from 38 to 47%, maintaining a high cutting performance. Thus, such new alloys are important alternates for tool industry. They meet the current requirements of increase in the cost of alloys and, thus, increase the competitiveness of the tools from these hard alloys for tool application.

EXAMPLE 3

As discussed, the suitable properties of the alloys of the present invention and the performance achieved are important for replacement of the alloys of the art with a significant cost reduction. This is made especially through the use of niobium as an alloy element and the thorough rebalancing of the chemical composition, concerning other alloy elements. However, niobium can cause inconveniences as for industrial applications in the case of large ingots, especially in terms of excessively large carbides.

Niobium carbides are formed directly from liquid, at a primary morphology, i.e., they grow on an isolated manner, or in a eutectic aspect. Primary carbides are the first ones to be formed and, therefore, they grow more. Given to its idiomorphic morphology, unlike the more needle-shaped aspect of eutectic carbides, primary carbides are not very fragmented during the hot conforming process. Thus, once coarse carbides are formed at the solidification process, they are going to continue to be coarse at the end product. Such carbides are unacceptable in many specifications, because of losses in toughness and, especially in rectifying properties. For the present invention, it is important that niobium carbides are maintained distributed and fine, since they are the main players in the resistance to wear.

New compositions have been studied to refine niobium carbides, as shown in Table 7 below. As shown in FIG. 9, the results obtained were based on the gross solidification microstructure, samples collected during the bath, in small 500-g ingots. The chemical composition has been based on alloy PI1, but the contents of nitrogen and cerium were changed.

The main way to avoid the problem of coarse primary carbides would be leading niobium more towards the formation of eutectic carbides, more easily broken, and less to the form of primary ones. For such a purpose, the formation of primary ones at high temperatures must be prevented or hindered, through performance at the nucleation of such carbides. Once they are nucleated at lower temperatures (or not nucleated), those carbides are going to grow less, and the remaining niobium is going to precipitate in the form of eutectic carbides.

This strategy was adopted in the present invention, in order to make the industrial production of alloys PI1 to PI4 easier. Therefore, the reduction of vanadium or niobium nitrides was employed. They are more stable than carbides, formed at higher temperatures and, thus, they act as nucleus to form niobium-rich carbides. The reduction of such nuclei causes the late formation of carbides and thus, their refinement. First of all, the effect of nitrogen reduction on the gross structure of solidification has been studied. As shown in FIG. 9, the reduction in the content of nitrogen reduces effectively the amount of coarse primary carbides.

TABLE 7

Chemical compositions based on alloy PI1 of the present invention, but with variations in the contents of nitrogen and cerium.

| Element | High N | Low N | High N + Ce | Low N + Ce |
|---|---|---|---|---|
| C | 1.09 | 1.09 | 1.07 | 1.05 |
| Si | 0.33 | 0.31 | 0.33 | 0.3 |
| Mn | 0.30 | 0.30 | 0.30 | 0.31 |
| P | 0.013 | 0.014 | 0.012 | 0.011 |
| S | 0.006 | 0.005 | 0.001 | 0.001 |
| Co | 0.03 | 0.03 | 0.03 | 0.03 |
| Cr | 3.92 | 3.85 | 3.87 | 3.81 |
| Mo | 3.25 | 3.25 | 3.24 | 3.19 |
| Ni | 0.08 | 0.08 | 0.08 | 0.07 |
| V | 1.74 | 1.73 | 1.77 | 1.71 |
| W | 3.37 | 3.36 | 3.37 | 3.33 |
| Cu | 0.03 | 0.03 | 0.03 | 0.03 |
| Ti | 0.009 | 0.009 | 0.008 | 0.007 |
| Nb | 1.74 | 1.77 | 1.87 | 1.77 |
| Al | 0.021 | 0.02 | 0.041 | 0.036 |

TABLE 7-continued

Chemical compositions based on alloy PI1 of the present invention, but with variations in the contents of nitrogen and cerium.

| Element | High N | Low N | High N + Ce | Low N + Ce |
|---|---|---|---|---|
| N (ppm) | 110 | 270 | 300 | 120 |
| Ce | — | — | 0.038 | 0.055 |

Despite this important effect of nitrogen, very low content of nitrogen, i.e., much lower than 100 ppm, they are difficult to be obtained in electric steel mills. Therefore, another method was applied to refine carbides, by adding cerium. This element forms oxynitrides at temperatures much higher than those for precipitation of niobium carbide. Thus, they act as a second way to reduce the content of free nitrogen to form nuclei of vanadium or niobium nitrides.

Therefore, as shown in FIG. 9, the reduction in the content of nitrogen associated with the addition of cerium at contents around 0.050% in the alloy of the present invention causes a significant refinement of the formed niobium carbides. This can be employed for situations in which refinement conditions for solidification speed are more critical, for instance in the case of larger ingots. However, the alloy of the present invention can also be produced at usual nitrogen contents and with no addition of cerium, since such two modifications entail a more thorough and expensive process, concerning steel mill practices.

EXAMPLE 4

The example above discusses only the refinement of niobium primary carbides. In this example, a possibility to refine niobium eutectic carbides by employing aluminum and silicon contents is presented. As shown in FIG. 10, high silicon and aluminum alloys have niobium eutectics with thin and longer "arms". This occurs especially in cobalt-free alloys, i.e., from alloy PI1 to alloy PI2. The reasons for such effect are not fully known yet, but they are probably related to the effect of aluminum and silicon solubility in primary carbides. Since they have low solubility in carbides, such elements are concentrated before solidification when at high contents, what makes its growth difficult and entails the refinement seen.

After rolling for 8-mm gauges, the effect of aluminum and silicon was compared at the microstructure of the material. As shown in FIG. 11, there is a slight refinement of the microstructure, especially in terms of the thinner population of carbides, at the bottom of the microstructure matrix. This fact is interesting, since it generates thinner austenitic grains, as discussed above in Table 5. Therefore, high contents of aluminum and silicon can be applied to the alloys of the present invention. However, as shown in Example 1, such contents can harm other properties, such the end hardness after the heat treatment. Additionally, high contents of aluminum lead to operating manufacture difficulties, since they increase reactivity of liquid metal, generate more ferrite hardening and increase temperatures required for annealing.

In short, high aluminum and silicon contents, from 1.0 to 1.5%, can be interesting in the alloys of the present invention, towards a further refinement of carbides and, as shown in example 1, to reduce the grain size. However, the application to which such material is intended must be examined, in view of the resulting hardness, in addition to manufacturing difficulties.

The invention claimed is:

1. Hard alloys with dry composition, having a chemical composition of elements consisting basically, as for mass percentage, of Carbon between 0.86 and 2.0, Chromium between 1.0 and 7.0, a Tungsten-equivalent, as given by ratio 2Mo+W, between 8.5 and 12.0, Niobium between 1.05 and 1.95, Vanadium between 1.3 and 3.0, Silicon between 0.8 and 3.0, Aluminum between 1.6 and 3.0, Cobalt lower than 10.0, Manganese from traces to 0.5, Phosphorus at a maximum of 0.04, Sulfur at a maximum of 0.005, Nitrogen lower than 0.03, rare-earth elements or actinides or Hf, Rf, Ac from 0.005 to 0.2, the remaining alloy substantially of Fe and impurities inevitable to the preparation process, wherein the alloy is produced by casting ingots, which are hot forged or rolled to the final application sizes.

2. Hard alloys with dry composition, having a chemical composition of elements consisting basically, as for mass percentage, of Carbon between 0.9 and 1.5, Chromium between 3.0 and 6.0, a Tungsten-equivalent, as given by ratio 2Mo+W, between 9.0 and 11.0, Niobium between 1.2 and 1.9, Vanadium between 1.4 and 2.0, Silicon between 0.8 and 1.2, Aluminum between 1.6 and 2.0, Cobalt lower than 7.0, Manganese from traces to 0.5, Phosphorous at a maximum of 0.04, Sulfur at a maximum of 0.005, Nitrogen lower than 0.015, rare-earth elements or actinides or Hf, Rf, La, Ac from 0.01 to 0.1, the remaining alloy substantially of Fe and impurities inevitable to the preparation process, producing the alloy by casting ingots, which are not forged or rolled to the final application sizes.

3. Hard alloys with dry composition, having a chemical composition of elements consisting basically, as for mass percentage, of Carbon between 0.9 and 1.5, Chromium between 3.0 and 6.0, a Tungsten-equivalent, as given by ratio 2Mo+W, between 9.2 and 10.8, Niobium between 1.5 and 1.9, Vanadium between 1.5 and 2.0, Silicon between 0.8 and 1.2, Aluminum between 1.6 and 1.8, Cobalt lower than 7.0, Manganese from traces to 0.5, Phosphorus at a maximum of 0.04, Sulfur at a maximum of 0.005, Nitrogen lower than 0.01, rare-earth elements or actinides or Hf, Rf, La, Ac from 0.03 to 0.07, the remaining alloy substantially of Fe and impurities inevitable to the preparation process, the alloy produced by casting ingots of which are hot forged or rolled to the final application sizes.

4. Hard alloys with dry composition, in accordance with claim 1, having, in mass percentage, elements Titanium, Zirconium or Tantalum replacing partially Niobium or Vanadium, at a ratio where 1 part of Ti corresponds to 1 part of Vanadium or 0.5 parts of Niobium, and 1 part of Ta or Zr corresponds to 2 parts of Vanadium or 1 part of Niobium.

5. Hard alloys with dry composition, in accordance with claim 1, wherein the alloy is used in cutting and machining tools.

6. Hard alloys with dry composition, in accordance with claim 1, wherein the alloy is used in saws, whether they are fully formed by high-speed steel or the bimetallic type, with the bimetallic type of cutting parts made in high-speed steel only.

7. Hard alloys with dry composition, in accordance with claim 1, wherein the alloy is used in rotating cutting tools employed to machine metallic materials.

8. Hard alloys with dry composition, in accordance with claim 1, wherein the alloy is used in machining tools with a low working life expectancy and low productivity industrial tools and home use tools.

9. Hard alloys with dry composition, in accordance with claim 2, having, in mass percentage, elements Titanium, Zirconium or Tantalum replacing partially Niobium or Vanadium, at a ratio where 1 part of Ti corresponds to 1 part of Vanadium or 0.5 parts of Niobium, and 1 part of Ta or Zr corresponds to 2 parts of Vanadium or 1 part of Niobium.

10. Hard alloys with dry composition, in accordance with claim 3, having, in mass percentage, elements Titanium, Zirconium or Tantalum replacing partially Niobium or Vanadium, at a ratio where 1 part of Ti corresponds to 1 part of Vanadium or 0.5 parts of Niobium, and 1 part of Ta or Zr corresponds to 2 parts of Vanadium or 1 part of Niobium.

11. Hard alloys with dry composition, in accordance with claim 2, wherein the alloy is used in cutting and machining tools.

12. Hard alloys with dry composition, in accordance with claim 3, wherein the alloy is used in cutting and machining tools.

13. Hard alloys with dry composition, in accordance with claim 4, wherein the alloy is used in cutting and machining tools.

14. Hard alloys with dry composition, in accordance with claim 2, wherein the alloy is used in saws whether they are fully formed by high-speed steel or by bimetallic saws, with the bimetallic saws made in high-speed steel only.

15. Hard alloys with dry composition, in accordance with claim 3, wherein the alloy is used in saws whether they are fully formed by high-speed steel or by bimetallic saws, with the bimetallic saws made in high-speed steel only.

16. Hard alloys with dry composition, in accordance with claim 4, wherein the alloy is used in saws whether they are fully formed by high-speed steel or by bimetallic saws, with the bimetallic saws made in high-speed steel only.

17. Hard alloys with dry composition, in accordance with claim 2, wherein the alloy is used in rotating cutting tools employed to machine metallic materials.

18. Hard alloys with dry composition, in accordance with claim 3, wherein the alloy is used in rotating cutting tools employed to machine metallic materials.

19. Hard alloys with dry composition, in accordance with claim 4, wherein the alloy is used in rotating cutting tools employed to machine metallic materials.

20. Hard alloys with dry composition, in accordance with claim 2, wherein the alloy is used in machining tools with a low working life expectancy and low productivity industrial tools and home use tools.

21. Hard alloys with dry composition, in accordance with claim 3, wherein the alloy is used in machining tools with a low working life expectancy and low productivity industrial tools and home use tools.

22. Hard alloys with dry composition, in accordance with claim 4, wherein the alloy is used in machining tools with a low working life expectancy and low productivity industrial tools and home use tools.

* * * * *